US007150223B2

(12) United States Patent
Schäfer et al.

(10) Patent No.: US 7,150,223 B2
(45) Date of Patent: Dec. 19, 2006

(54) DEVICES AND METHODS FOR THE ALIGNMENT OR MOUNTING OF A COVERING APPLIED TO A CYLINDER IN A PRINTING MACHINE

(75) Inventors: Karl Robert Schäfer, Rimpar (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 57 days.

(21) Appl. No.: 10/496,004

(22) PCT Filed: Nov. 28, 2002

(86) PCT No.: PCT/DE02/04364

§ 371 (c)(1),
(2), (4) Date: May 28, 2004

(87) PCT Pub. No.: WO03/047863

PCT Pub. Date: Jun. 12, 2003

(65) Prior Publication Data

US 2005/0005793 A1 Jan. 13, 2005

(30) Foreign Application Priority Data

Nov. 28, 2001 (DE) ..... 101 58 158
Aug. 21, 2002 (DE) ..... 102 38 124

(51) Int. Cl.
*B41F 5/00* (2006.01)
*B41F 27/12* (2006.01)

(52) U.S. Cl. ..... 101/216; 101/275; 101/477; 101/485; 101/486

(58) Field of Classification Search ..... 101/216
See application file for complete search history.

(56) References Cited

U.S. PATENT DOCUMENTS

| | | | |
|---|---|---|---|
| 5,331,892 | A | 7/1994 | Seib et al. |
| 5,526,747 | A | 6/1996 | Marmin et al. |
| 5,537,922 | A | 7/1996 | Becker |
| 5,671,674 | A | 9/1997 | Nobuta et al. |
| 5,806,431 | A | 9/1998 | Muth |
| 6,135,027 | A | 10/2000 | Rudzewitz et al. |
| 6,199,280 | B1 | 3/2001 | Schneider et al. |
| 6,393,986 | B1 | 5/2002 | Tobe et al. |
| 6,467,412 | B1 | 10/2002 | Tobe et al. |
| 6,474,237 | B1 | 11/2002 | Fujishiro et al. |
| 6,854,392 | B1 | 2/2005 | Tobe |
| 2002/0157553 | A1 | 10/2002 | Ramsay |
| 2003/0167946 | A1 | 9/2003 | Schneider et al. |

FOREIGN PATENT DOCUMENTS

| | | |
|---|---|---|
| DE | 44 17 054 | 11/1995 |
| DE | 196 20 997 | 3/1998 |

(Continued)

*Primary Examiner*—Daniel J. Colilla
*Assistant Examiner*—Marvin P. Crenshaw
(74) *Attorney, Agent, or Firm*—Jones, Tullar & Cooper, PC

(57) ABSTRACT

Devices for accomplishing the alignment of a covering applied to a cylinder in a printing machine include a detent and a roller element. The detent is situated in a mounting direction of the covering and is upstream of the roller element. The covering to be applied engages with the detent. In an alternative configuration, the roller can itself act as the detent. A method for aligning or for mounting the covering on the cylinder utilizes the detent or the roller element.

11 Claims, 3 Drawing Sheets

FOREIGN PATENT DOCUMENTS

| | | |
|---|---|---|
| DE | 197 19 559 | 11/1998 |
| DE | 198 03 725 | 8/1999 |
| DE | 198 38 777 | 3/2000 |
| DE | 100 18 923 | 12/2000 |
| DE | 100 24 329 | 11/2001 |
| EP | 0 678 383 | 2/1995 |
| EP | 0 570 702 | 4/1995 |
| EP | 1 084 838 | 9/2000 |
| EP | 1 101 612 | 10/2000 |
| EP | 1 084 837 | 3/2001 |
| EP | 1 155 840 | 5/2001 |
| EP | 1 391 300 | 2/2004 |
| JP | 2000-94640 | 4/2000 |
| JP | 2001-277472 | 10/2001 |
| JP | 2002-234138 | 8/2002 |

DEVICES AND METHODS FOR THE ALIGNMENT OR MOUNTING OF A COVERING APPLIED TO A CYLINDER IN A PRINTING MACHINE

FIELD OF THE INVENTION

The present invention is directed to devices and to methods for aligning or mounting a dressing applied to a cylinder of a printing press. At least one detent and at least one rolling element can be used. The detent is situated upstream of the rolling element.

BACKGROUND OF THE INVENTION

A device for mounting and for removing at least one dressing on or from a cylinder of a printing press with the aid of several rollers arranged along the cylinder is known from DE 100 24 329 A1. A detent, which is arranged fixed in place and spaced apart from the cylinder, aids the exact application of the leading end of the dressing by the use of a bevel which is facing the cylinder. Furthermore, one or several rollers, which are located upstream in the mounting direction, are pivotable and can be placed against the cylinder. In accordance with one preferred embodiment, a beveled end of a printing forme rests on the cylinder, viewed in the production direction of the cylinder, in front of a groove opening, while this end contacts the groove. The introduction of a suspension leg formed on the leading end of the dressing into an opening on the cylinder cannot be effectively aided by this prior device.

A device for changing of printing formes on rotary printing presses is known from EP 0 678 383 A1. A printing forme, which has been removed from a forme cylinder, after its complete removal from the forme cylinder, temporarily rests with its beveled front edge against a contact pressure roller placed against the forme cylinder. In the further course of the removal of the printing forme, it is conveyed upward, against gravitational force, along an inclined push-out path until the front end of the printing forme is finally deposited on an angled holding bracket, which angled holding bracket is arranged in the front area of the push-out path. For a fresh printing forme to be mounted on the forme cylinder, the device has two holding elements, which delimit an inclined insertion path in the front area and which can be moved linearly in opposite directions in the axial direction of the forme cylinder, on which the front end of the to be mounted new printing forme rests until the time of mounting of the fresh printing forme. The holding elements are laterally moved away during the mounting of the fresh printing forme, so that they are clear of the path to the forme cylinder for the fresh printing forme.

A rotary printing press with a mounting device is known from EP 1 084 838 A1. A printing forme to be initially mounted on a forme cylinder is pushed out of the device until it touches a contact pressure roller that is placed against the forme cylinder with its end which is in front in the mounting direction. Thereafter, the fresh printing forme is pulled onto the surface of the forme cylinder. No suggestion regarding the alignment of the printing forme, by the use of a contact pressure roller, is provided.

A device for mounting a dressing on a cylinder of a printing press is known from DE 197 19 559 A1. The, device has two sliders, which are arranged one behind the other in the circumferential direction and which are aligned parallel with each other. An acute-angled bevel at the leading end of the dressing to be mounted, the sliders and a slit-shaped opening formed on the surface of the cylinder, with respect to an imagined tangent placed on the opening, have an acute opening angle of the same size. The dressing, with its bevel on its leading end, is guided against the slider which is in the rear in the circumferential direction and is placed against the surface of the cylinder and makes contact there. The slider, which is in front in the circumferential direction of the cylinder, is moved away from the surface of the cylinder. For mounting a dressing, the front slider pushes the bevel of the latter into the opening by use of its side facing the surface. A roller element is arranged, viewed in the mounting direction of the dressing, downstream of the rear slider and is connected with this slider.

A method and a device for the automatic placement of a printing plate on a plate cylinder of a rotary printing press is known from EP 1 101 612 A2. The printing plate, which is grasped by a gripper, is guided with its beveled leading end substantially radially against a transfer cylinder, which is arranged parallel with the plate cylinder and which works together with it, and which is aligned parallel with the plate cylinder. The beveled leading end is placed on the surface of the transfer cylinder, wherein the placement of the end of the printing plate takes place on a curved element on the surface of the transfer cylinder facing the plate cylinder.

A method and a device for mounting a printing forme which is guided to a forme cylinder is known from U.S. Pat. No. 5,671,674. The printing forme has an acute-angled bevel on its leading end. A rolling element is provided. The rolling element is placed against the forme cylinder and rolls off on the leading end of the printing forme. In the course of this, the rolling element pushes the bevel of the printing forme into an opening formed in the surface of the forme cylinder.

A method and a device for mounting a printing forme which is guided to a forme cylinder is also known from EP 1 155 840 A. The printing form has an acute-angled bevel on its leading end. A rolling element, which is placed against the forme cylinder and which rolls off on its surface, is provided. The leading end of the printing forme is guided against the rolling element. The rolling element, in the course of a rotation of the forme cylinder, pushes the bevel at the leading end of the printing forme into an opening, which is formed in the surface of the forme cylinder, as soon as the opening and the bevel face each other.

SUMMARY OF THE INVENTION

The object of the present invention is directed to providing devices and methods for use in aligning or mounting a dressing applied to a cylinder of a printing press.

In accordance with the present invention, this object is attained by the provision of at least one of a detent and a rolling element that are positioned along a path of dressing travel to a cylinder on which the dressing is to be mounted. The detent has a slope which cooperates with a tangent at a point of intersection of the slope with the cylinder, to define an acute angle that opens toward the dressing. If only a roller element is used for mounting the dressing, the bevel on the leading end of the dressing contacts the roller element surface, which surface of the rolling element lies within two legs of an opening angle whose vertex coincides with the rotational axis of the rolling element. One leg is a line that is perpendicular to the surface of the cylinder.

The advantages to be gained by the present invention lie, in particular, in that by use of the subject device, it is possible to introduce a dressing to be clamped on a cylinder into an opening in the cylinder in such a way that, in the course of a rotation of the cylinder, the dressing is pulled, to a great extent, automatically into the cylinder opening for being subsequently fastened therein. In particular, in connection with a detent arranged upstream of a rolling element, the danger of injury to an operator is reduced. The arrangement of the detent and the rolling element of the present invention prevents access to dangerous areas.

BRIEF DESCRIPTION OF THE DRAWINGS

Preferred embodiments of the present invention are represented in the drawings and will be explained in greater detail in what follows.

Shown are in.

DESCRIPTION OF PREFERRED EMBODIMENTS

Figure 1:
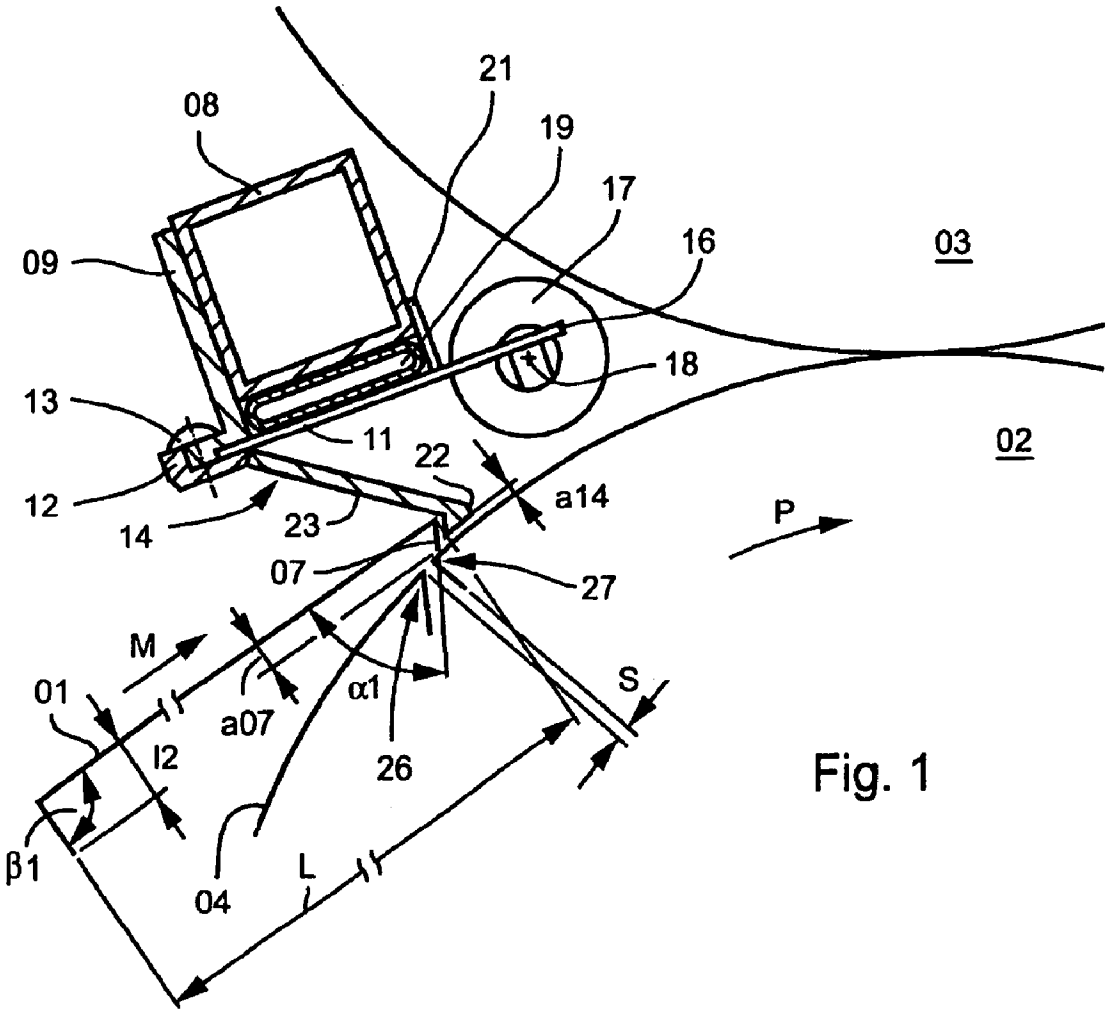
FIG. 1, a first preferred embodiment of a device in accordance with the present invention for the alignment of a dressing applied to a cylinder of a printing press, and having a detent and a rolling element, with the rolling element being moved away from the cylinder, in FIG. 2, the device for the alignment of a dressing applied to a cylinder of a printing press in accordance with FIG. 1 and having a detent and a rolling element, with the rolling element being moved against the cylinder, and in FIG. 3, a second preferred embodiment of a device in accordance with the present invention for the alignment of a dressing applied to a cylinder of a printing press, and having a rolling element as the detent.
Figure 2:
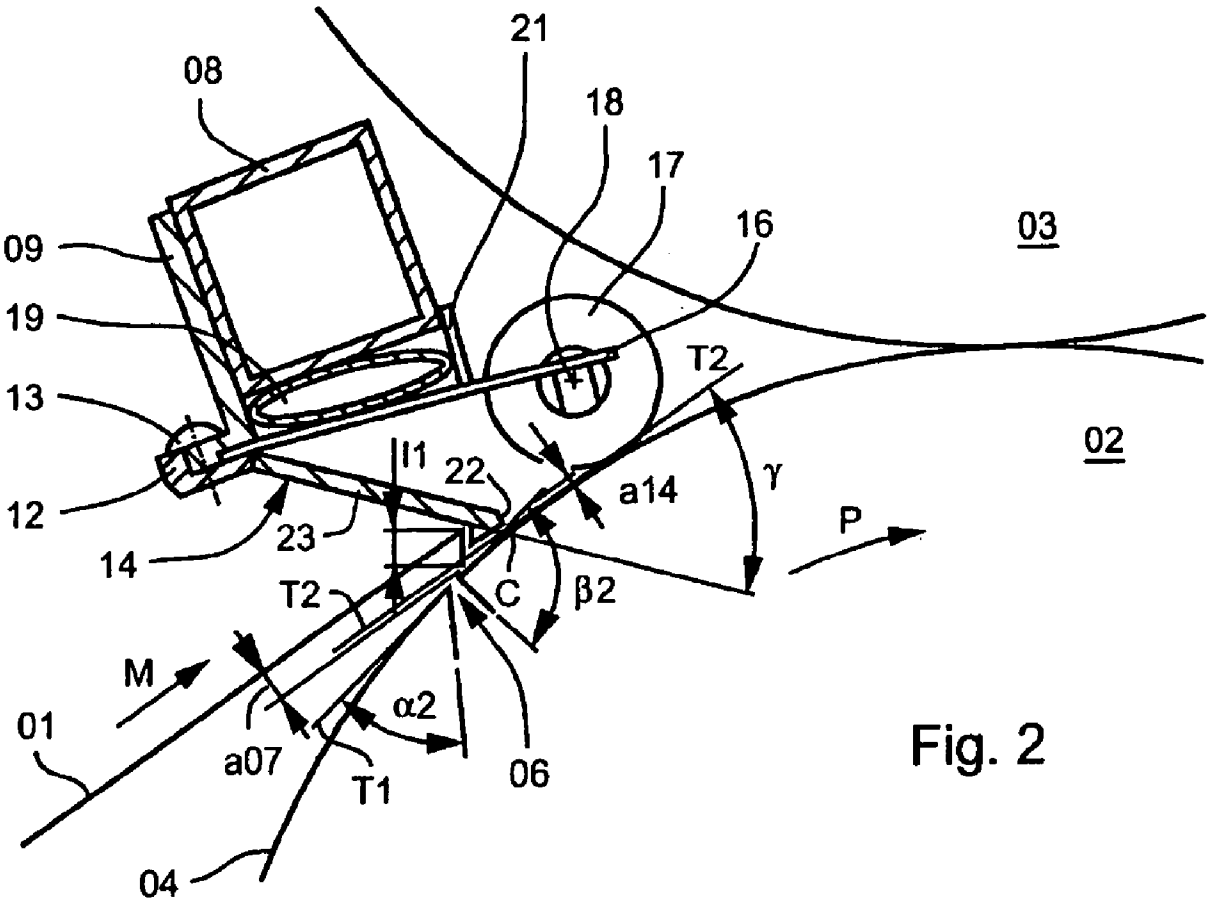
Figure 3:
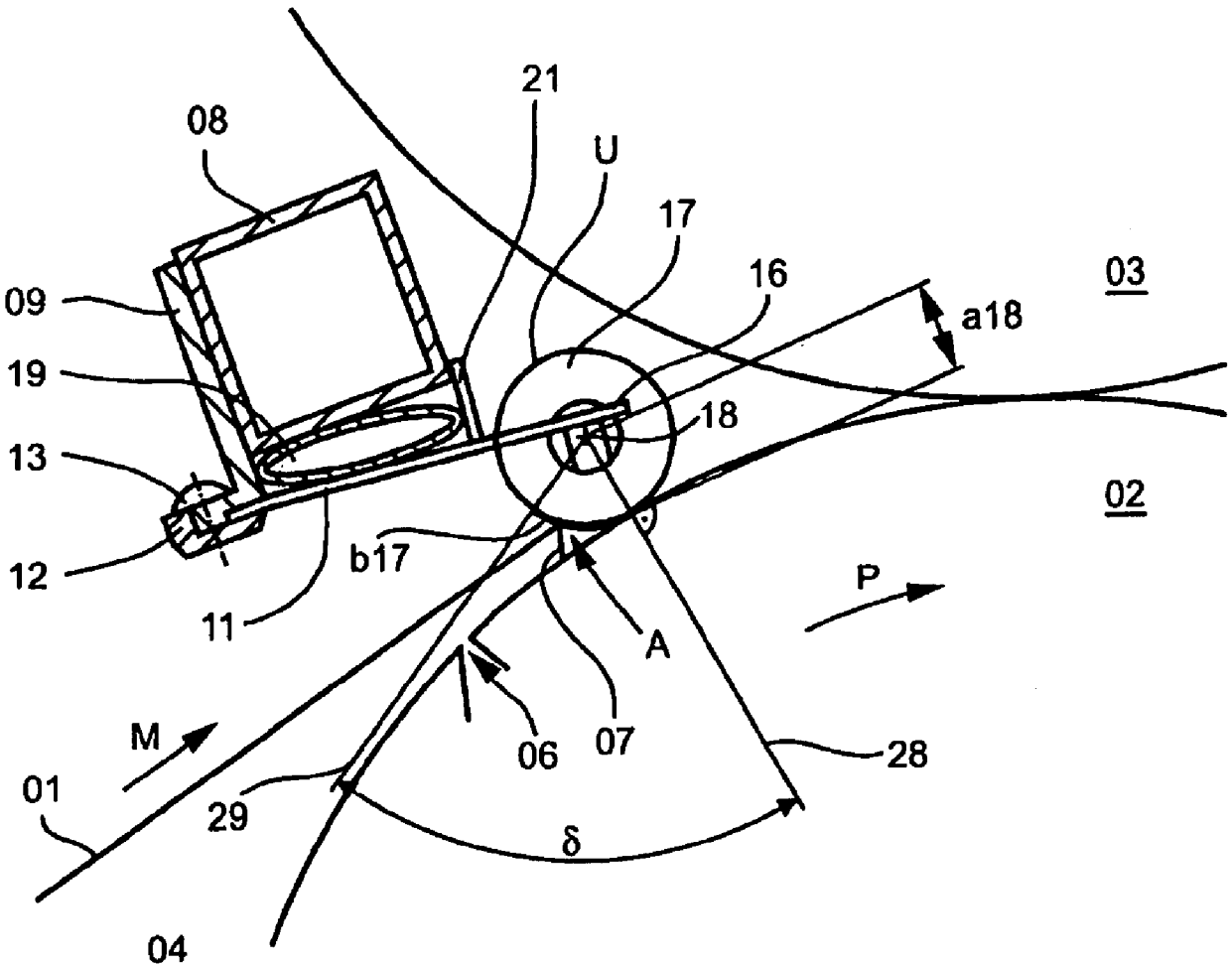

In a printing press, for example a web-fed rotary printing press, as depicted schematically in FIGS. 1, 2 and 3, a cylinder 02, preferably a forme cylinder 02, on which at least one dressing 01, which may be for example, a flexible printing forme 01 can be placed, rolls off on or in contact with a counter-pressure cylinder 03, for example a transfer cylinder 03. On its surface 04, the forme cylinder 02 has at least one slit-shaped opening 06, as seen in FIG. 2, which opening 06 preferably extends linearly or axially in respect to the forme cylinder 02, and into which opening 06 a bevel 07, that is arranged on one end of the dressing 01, can be inserted, preferably in a positive manner.

The dressing 01 which, for example, is embodied as a plate-shaped printing forme 01 or as a support plate supporting a printing blanket, has a substantially rectangular surface of a length L and of a width. The dressing 01 has a support side with which, in the mounted state, the dressing 01 rests on a surface 04 of a cylinder 02. The side of the dressing located opposite the support side is a dressing work surface which, in case the dressing 01 is embodied as a printing form 01, is provided with a printed image or which can be provided with a printed image. The dressing 01 has two ends located opposite each other. A bevel 07, in the form of an angled-off suspension leg, is arranged on at least one end of the dressing 01, wherein the suspension leg or bevel 07 extends over the width of the dressing 01. The surface of the dressing is flexible at least along the length L and can be matched to the curvature of the cylinder surface 04 when the dressing 01 is applied to the surface 04 of the cylinder 02. In the mounted state of the dressing 01, the length L of the dressing surface thus extends in the direction of the circumference of the cylinder 02, while the width of the dressing surface extends in the axial direction of the cylinder 02.

The at least one suspension leg or bevel 07 of the dressing 01 is fixed in place by the use of a fastening device, wherein the fastening device is arranged in a cylinder groove, wherein, as a rule, the cylinder groove extends in the axial direction with respect to the cylinder 02. An end of the dressing 01, which is aligned with the production direction of rotation P of the cylinder 01, is called the dressing's leading end, while the oppositely located end is the trailing end of the dressing 01. In this case, the production direction of rotation P of the cylinder 02 is the direction of rotation of the cylinder 02 during the printing process and is shown with an arrow in FIGS. 1, 2 and 3. At least the ends of the dressing 01, with the suspension legs formed thereon, are made of a rigid material, such as, for example, metallic material, for example an aluminum alloy. Customarily, the material thickness of the dressing 01, or at least the material thickness of the suspension legs, is a few tenths of a millimeter. For example, the thickness of the dressing 01 may be from 0.2 mm to 0.4 mm, and preferably 0.3 mm. Thus, the dressing 01, as a whole, or at least its ends, consists of a dimensionally stable material, so that the ends can be permanently deformed by being bent against a material-specific resistance.

In a preferred embodiment, suspension legs have been formed at both leading and trailing ends of the dressing 01 along a bending edge, wherein the suspension legs can be inserted into a narrow opening 06, in particular embodied in a slit-shape, of the cylinder 02, and can be fastened there by operation of the fastening device. In respect to the length L of the level surface, or non-arched support side of the non-mounted dressing 01, a leading suspension leg is angled on its one end at a bending edge with an opening angle $\alpha$ 1, and on its other or trailing end a suspension leg is angled at a bending edge at an opening angle $\beta$ 1, wherein, as a rule, the opening angles $\alpha$ , $\beta$ each lie between 30° and 140°. If the opening angle $\alpha$ 1 is assigned to a leading end of the dressing 01, it preferably is embodied as an acute angle and in particular is 45°. The opening angle $\beta$ 1 at the trailing end of the dressing 01 is often embodied to be 80°, or as an obtuse angle. In particular it is 85° or 135°. The beveled suspension leg at the leading end has a length l1 which, for example, lies in the range of 4 mm to 11 mm, and in particular lies between 4 mm and 8 mm, wherein 6 mm is the preferred measurement. The beveled suspension leg at the trailing edge has a length l2, which is, for example, 6 mm to 15 mm, and in particular is 8 mm and 12 mm, wherein the shorter length is typically preferred in order to assure the easiest possible removal of the trailing edge from the opening 06 of the cylinder 02.

The cylinder 02 has at least one narrow, slit-shaped opening 06, of a slit width S, on its surface 04, wherein the slit width S is less than 5 mm and preferably lies in a range between 1 mm and 3 mm. The opening 06 has a front edge 26 in the production direction P of the cylinder 02, and a rear edge 27, as seen in FIG. 1. An acute opening angle $\alpha$ 2, which is between 30° and 50°, preferably 45°, is formed between the wall extending from the front edge toward the groove and an imaginary first tangent T1, resting on the surface 04 of the cylinder 02 at the opening 06, as seen in FIG. 2. Thus, the beveled suspension leg at the leading end of the dressing 01 can be suspended, preferably positively connected, at this front edge 26 of the opening 06, because the opening angle $\alpha$ 1 of the suspension leg at the leading end of the dressing 01 is preferably matched to the opening angle $\alpha$ 2. The same applies to the trailing end of the dressing 01. An opening angle $\beta$ 2, which is between 80° and 95°, and preferably 90°, or between 120° and 150°, and preferably 135°, is formed between the wall extending from the rear edge 27 toward the groove 06 and a imaginary first tangent T1 resting on the surface 04 of the cylinder 02 at the opening 06. Thus, the beveled suspension leg at the trailing end of the dressing 01 can be suspended, preferably positively connected, at this rear edge 27 of the opening 06, because the opening angle β 1 of the beveled suspension leg at the trailing end of the dressing 01 is preferably matched to the opening angle β 2.

For example, at least one preferably pivotably seated holding device and one preferably pre-stressed spring element, which are not specifically represented are arranged in the groove, wherein the spring element pushes the holding device against the beveled suspension leg at the trailing end, for example, which is suspended in the opening 06 on its rear edge 27. The suspension leg at the trailing end is thus maintained on the wall extending from the rear edge 27 toward the groove. An actuating device, for releasing the pressure exerted by the holding element, is provided in the groove which, when actuated, pivots the holding device against the force of the spring element. Accordingly, the holding assembly substantially consists of the holding device, the spring element and the actuating device.

The cylinder 02 can be such that several dressings 01, preferably of the same type, can be arranged on its surface 04. If the cylinder 02 is embodied as a forme cylinder 02, six plate-shaped printing formes 01, for example, can be placed side-by-side in the axial direction of the forme cylinder 02. More than one dressing 01 can be attached to the cylinder 02 in the direction of its circumference. For example, two grooves, each extending axially in respect to the cylinder 02 and with assigned openings 06, can be provided on cylinder 02, which two grooves are arranged, offset by 180° with respect to each other, at the circumference of the cylinder 02. With this covering of the cylinder 02 with two dressings 01, which are arranged one behind the other along the circumference of cylinder 02, the leading end of the one dressing 01 is fastened in the one groove, while the trailing end of the same dressing 01 is fastened in the other groove. This correspondingly applies to the remaining dressing, or dressings 01 arranged on this cylinder. The dressings 01, which are arranged side-by-side in the axial direction of the cylinder 02, can also be arranged offset with respect to each other, for example individually or in pairs each by one half of the length L of the dressing 01. This, however, requires further grooves with assigned openings 06, or at least parts of these further grooves, to be cut into the cylinder 02, which further grooves or parts of grooves are arranged with respect to each other about the circumference of the cylinder 02, for example offset by 90°, in respect to the two previously mentioned grooves and openings 06.

A cross bar 08 which, for example, can be a rigid hollow profiled section of square cross section, and which extends linearly or axially with respect to the cylinders 02, 03, is arranged, fixed in place with respect to the forme cylinder 02, for example, preferably in a space upstream of, and between the forme cylinder 02 and the counter-pressure cylinder 03, i.e. in the gap or in the space defined by the surfaces 04 of these two cooperating cylinders 02, 03. A support 11 is fastened either directly or through a connecting piece 09 which, for example, can be an L-shaped strip, on this cross bar 08. Support 11 has a first end 12, by the use of which support first end 12, the support 11 is fastened on the cross bar 08 or on a connecting piece 09. The fastening of the first end 12 of the support 11 is preferably provided by the use of a connecting element 13, which can be a screw 13 or a rivet 13. Thus, the first end 12 of the support 11 is not hinged, but is clamped, in particular is rigidly clamped to the cross bar 08, either directly or through the intermediate connecting piece 09.

In the preferred embodiment represented in FIGS. 1 and 2, at least one detent 14, which is angled off in a direction toward the forme cylinder 02, is attached to the first end 12 of the support 11, or to the connecting piece 09. The detent 14 has, for example at least on a detent side 23 facing the dressing 01, a detent side 23 slope directed toward the surface 04 of the cylinder 02, wherein an imaginary straight extension of this detent side 23 slope intersects the surface 04 of the cylinder 02 at a point C, as seen in FIG. 2. A preferably acute opening angle γ exists between a second tangent T2 placed against the surface 04 of the cylinder 02 at this intersection point C and the detent side 23 slope, or its extension. The angle γ, represented as a vertical and opposite angle in FIG. 2 facing the dressing 01 is maximally 90°, preferably between 40° to 60°, and in particular is 45°. The detent 14 is arranged so close to the surface 04 of the cylinder 02 that a dressing 01 to be mounted, which is being applied to the forme cylinder 02, contacts the detent 14, and simultaneously rests on the surface 04 of the cylinder 02 with its bevel 07 that is attached to its leading end.

By utilization of the detent side 23 slope formed on the detent 14 and facing the forme cylinder 02, an alignment of the bevel 07 of a dressing 01 to be mounted on the forme cylinder 02 is aided. This bevel 07 at the leading end of a dressing 01 is guided to the opening 06 cut into the surface 04 of the forme cylinder 02 while the forme cylinder 02 rotates in its production direction P. In this case, the detent 14 can be embodied as a strip 14, which preferably extends longitudinally with respect to the forme cylinder 02 and which is either of one piece or of several pieces, which several pieces are possibly arranged spaced apart from each other. Such a strip 14 can simultaneously take on the function of a finger protection strip situated between the forme cylinder 02 and the counter-pressure cylinder 03, for example. The detent 14 can be fastened on the support 11, or on the connecting piece 09, for example by utilization of the previously described connecting element 13.

On a second end, which is located opposite to the first end 12 of the support 11, at least one rotatably seated rolling element 17 is arranged. When it is placed against the forme cylinder 02, the rolling element 17 can roll off on cylinder surface 04, or on a dressing 01 which is resting on the surface 04, as depicted in FIG. 2, because of which rolling contact between rolling element 17 and cylinder surface 04 the bevel 07, which is arranged on one end of the dressing 01, is pressed into the opening 06 in the surface 04 of the cylinder 02, and a dressing 01 is pressed against the surface 04 of the forme cylinder 02. The rotational axis 18 of the rolling element 17 extends longitudinally with respect to the forme cylinder 02 and is parallel to a forme cylinder axis of rotation. The rolling element 17 is preferably embodied as at least one, or as several separate rolls 17, or as one roller 17.

In the preferred embodiment depicted in FIGS. 1 and 2, the rolling element 17 is arranged, viewed in the mounting direction M of the dressing 01, downstream of, or after the detent 14. The detent 14 initially guides the bevel 07 of the leading end of the dressing 01 to be mounted on the forme cylinder 02 into the opening 06 cut into the surface 04 of the forme cylinder 02. In this position, the bevel 07 of the dressing 01, as viewed in the production direction P of the forme cylinder 02, is situated downstream of the opening 06 on the surface 04 of the forme cylinder 02. In the course of a relative movement between the detent 14 and the surface 04 of the forme cylinder 02, which relative movement can be a linear movement of the detent 14 directed in a direction opposite the mounting direction M of the dressing 01, but which relative movement is preferably a rotation of the forme cylinder 02 in its production direction P, the bevel 07 is pushed in the direction toward the opening 06 and is then hooked in the opening 06 since the bevel 07 falls into the opening 06 because of the inherent weight of the dressing 01. In the course of a further rotation of the forme cylinder 02 in its production direction P, the dressing 01 is pulled onto the forme cylinder 02 and in doing so, passes underneath the detent 14, i.e. between a free end 22 of the detent 14, which is located a slight vertical distance a14 from the surface 04 of the forme cylinder 02 and which preferably faces the surface 04 of the forme cylinder 02, and this surface 04 of the forme cylinder 02. In this case, the distance a14 is only a few millimeters, for example, this distance may be 1 to 3 millimeters. Thus, this distance a14 is less than a distance a07 which distance a07 is the height of the bevel 07 when this bevel 07 stands on the surface 04 of the forme cylinder 02 and has not yet been introduced into the opening 06. To assure the correct seating of the bevel 07 of the dressing 01 against a wall of the opening 06, which correct seating is defined as a positive engagement of the bevel 07 against the wall of the opening 06, the rolling element 17, which has been placed against the forme cylinder 02, rolls over the dressing 01, by which contact, the dressing 01 is firmly pressed against the surface 04 of the forme cylinder 02.

The support 11 for the rolling element 17 itself can advantageously be an elastically bendable, i.e. reversibly deformable, body, which is preferably embodied as a leaf-shaped element, such as a leaf spring. Thus, the support 11 can be configured as a plate of spring steel 11, for example, which is firmly clamped at its first end 12.

An actuating mechanism 19 can be provided for the rolling element 17, wherein the actuating mechanism 19 is preferably embodied as a reversibly deformable hollow body 19, for example as a hose 19, which hose 19 can be charged with a pressure medium. When actuated, i.e. when charged with the pressure medium, for example, the actuating mechanism 19 acts, on a first side on the support 11, and is in engagement, on the other side by the cross bar, as seen in 08 FIG. 1. Because of the actuation of the actuating mechanism 19, the second end 12 of the support 11 can be deflected in the direction toward the forme cylinder 02 by an elastic bending of the support 11, and the rolling element 17 can thus be placed against the cylinder 02 as depicted in FIG. 2. At the termination of the actuation of the actuating mechanism 19, the support 11 returns to its original position because of its elasticity, i.e. because of its resilient property. As a result, the rolling element 17 is moved back away from the surface 04 of the forme cylinder 02, or from a dressing 01 resting on the surface 04 of the forme cylinder 02, i.e. the rolling element 17 comes out of contact with the dressing 01.

FIGS. 1 and 2 show the same first preferred embodiment, by way of example, of a device for guiding, aligning and pressing a dressing 01 against a cylinder 02 of a printing press shown in two different operating states, namely in the operating state, with a rolling element 17 moved away in FIG. 1, and in FIG. 2 in the operating state, with a rolling element 17 in contact. In both operating states, a dressing 01, which is being applied to a cylinder 02, is aligned by the first preferred embodiment of the device in accordance with the present invention with an opening 06 cut into the cylinder 02, which opening 06 is preferably in the form of a slit, so that, viewed in the production direction P of the cylinder 02, a bevel 07 attached to a leading end of the dressing 01 can be fastened in the opening 06.

If the actuating mechanism 19 is installed between the support 11 and the cross bar 08, it is advantageous to form or to attach a strip 21, for example on the support 11, which strip 21 protects the actuation mechanism 19 and which prevents it from unintentionally slipping out or from removal from its place of attachment.

In connection with some applications of the present invention, for example, in the arrangement of several printing formes 01 side-by-side in the axial direction on the surface 04 of the forme cylinder 02, it is advantageous to arrange several supports 11 side-by-side in the axial direction of the forme cylinder 02, each support 11 with at least one rolling element 17, and wherein the supports 11 can be moved against or away from the cylinder 02 independently of each other individually, or in groups, by separate actuating mechanisms 19 assigned to each of them. In this way, either a single rolling element 17, or a group of rolling elements 17, can be selectively used for pressing a defined printing forme against the surface 04 of the forme cylinder 02.

In a further preferred embodiment of the present invention as shown in FIG. 3, the provision of a strip, which is arranged close to the cylinder 02 and having the function of a detent, has been omitted. At least one rolling element 17, which preferably can be positioned against and away from the cylinder 02, and which at least one rolling element 17 may be for example, a roller extending linearly in the axial direction with respect to the cylinder 02, or one or several rolls, here take on the function of the detent. A dressing 01, preferably moved tangentially against the cylinder 02, comes in contact with the circumference U of the rolling element 17 within an arc of a curved segment b17 of the rolling element 17, which segment b17 is facing the cylinder 02. A contact point A of the dressing 01 with the rolling element 17 is located closer to the surface 04 of the cylinder 02 than a spacing distance a18 of the rotational axis 18 of the rolling element 17 from the surface 04 of the cylinder 02. The curved segment b17 lies between two legs 28, 29 of an opening angle δ, wherein a vertex of the opening angle δ coincides with the rotational axis 18 of the rolling element 17, a first leg 28 of the opening angle δ forms a perpendicular distance line extending from the vertex to the surface 04 of the cylinder 02, and the opening angle δ is at most 60°, and in particular is at most 45°.

As can be seen in FIG. 3, the bevel 07 at the front end of the printing forme 01 is in simultaneous contact with the rolling element 17, as well as with the surface 04 of the cylinder 02. Because of this simultaneous contact, the rolling element 17 aligns the dressing 01 in the linear or axial direction of the cylinder 02. In the course of a relative movement between the rolling element 17 and the surface 04 of the cylinder 02, during which relative movement of the cylinder 02 is preferably rotated in the production direction P, the rolling element 17, which is placed against the cylinder 02, rolls off on the surface 04 of the cylinder 02 in such a way that the rolling element 17 guides the dressing 01, with its bevel 07 which is in contact with the rolling element 17, so that the bevel 07 is inserted into an opening 06 cut into the surface 04 of the cylinder 02 and which opening 06 is preferably embodied in a slit shape, and pushes bevel 07 into the opening 06 for the purpose of holding the dressing 01 on the surface 04 of the cylinder 02. In the course of the mounting of the dressing 01, an operational state is also reached in which the bevel 07 on the leading end of the dressing 01, as the dressing 01 is applied to the cylinder 02, contacts the curved segment b17 and simultaneously protrudes at least partially into the opening 06 cut into the surface 04 of the cylinder 02. Thus, the alignment of the dressing 01 applied to the cylinder 02 preferably also takes place with respect to the opening 06 in the cylinder 02 in which the bevel 07 of the dressing 01 is kept. The end of the dressing 01 to be aligned and which is resting on the surface 04 of the cylinder 02 preferably is that end of the dressing 01 which also leads in the production direction P of the cylinder 02.

While preferred embodiments of devices and methods for the alignment and mounting of a covering applied to a cylinder in a printing machine, in accordance with the present invention, have been set forth fully and completely hereinabove, it will be apparent to one of skill in the art that various changes in, for example, the drives for the cylinders, the sizes of the cylinders, and the like could be made without departing from the true spirit and scope of the present invention which is accordingly to be limited only by the following claims.

What is claimed is:

1. A method for aligning a dressing on a cylinder of a printing press including:

providing a dressing support surface on said cylinder;

supporting a rolling element adjacent said dressing support surface;

aligning a rotational axis of said rolling element with an axis of rotation of the cylinder;

spacing said rotatinal axis of said rolling elment at a first distance from said dressing aupport surface;

feeding a dressing having a bevel end to said dressing support surface;

contacting said bevel end with said rolling element at a bevel end rolling element contact point and simultaneously with said dressing support surface;

locating said bevel end rolling contact point at a second distance from said dressing support surface, said second distance being less than said first distance; and using said rolling element for aligning said dressing bevel end on said dressing support surface linearly with respect to said cylinder axis of rotation.

2. The method of claim 1 further including providing a curved surface segment on said rolling element and facing said dressing support surface, and contacting said curved surface segment with said dressing bevel end.

3. The method of claim 1 further including providing a bevel end receiving opening in said dressing support surface and using said rolling element for aligning said bevel end with said bevel end receiving opening.

4. The method of claim 2 further including defining an opening angle having first and second legs and positioning a vertex of said opening angle at a rotational axis of said rolling element, positioning one of said first and second legs perpendicular to said dressing support surface, providing said opening angle being no greater than 60° and locating said curved surface segment between said first and second legs.

5. The method of claim 4 further including providing said opening angle being no greater than 45°.

6. The method of claim 1 further including providing said dressing bevel end as a dressing leading end in a production direction of rotation of said cylinder.

7. The method of claim 1 further including supporting said rolling element for movement against and away from said dressing support surface.

8. The method of claim 1 further including providing said rolling element extending in an axial direction of said cylinder.

9. The method of claim 3 further including providing said bevel receiving opening on said dressing support surface having a width of between 1 mm and 3 mm.

10. The method of claim 1 further including providing said cylinder being a forme cylinder, providing a transfer cylinder cooperating with said forme cylinder at a contact point and locating said rolling element adjacent said contact point.

11. A method for aligning a dressing on a cylinder of a printing press including:

providing a dressing support surface on said cylinder;

supporting a rolling element adjacent said dressing support surface;

aligning a rotational axis of said rolling element with an axis of rotation of the cylinder;

spacing said rotational axis of said rolling element at a first distance from said dressing support surface;

feeding a dressing having a bevel end to said dressing support surface;

providing a bevel end receiving opening in said dressing support surface contacting said bevel end with said rolling element at a bevel end rolling element contact point and simultaneously with said dressing support surface locating said bevel end rolling contact point at a second distance from said dressing support surface, said second distance being less than said first distance;

using said rolling element for aligning said dressing bevel end on said dressing support surface linearly with respect to said bevel end receiving opening and said cylinder axis of rotation;

rotating said cylinder in a direction of rotation; and inserting said dressing bevel end into said bevel end receiving opening in response to said rotating of said cylinder.

* * * * *